US007779656B2

(12) United States Patent
Dias et al.

(10) Patent No.: US 7,779,656 B2
(45) Date of Patent: Aug. 24, 2010

(54) KNITTING TECHNIQUES

(75) Inventors: Tilak Kithsiri Dias, Stockport (GB); Kimberley Mitcham, Leicester (GB); William Hurley, Stockport (GB)

(73) Assignee: Smartlife Technology Limited, Congleton, Cheshire (GB)

( * ) Notice: Subject to any disclaimer, the term of this patent is extended or adjusted under 35 U.S.C. 154(b) by 0 days.

(21) Appl. No.: 12/088,394

(22) PCT Filed: Sep. 29, 2006

(86) PCT No.: PCT/GB2006/003651

§ 371 (c)(1),
(2), (4) Date: Sep. 3, 2008

(87) PCT Pub. No.: WO2007/036746

PCT Pub. Date: Apr. 5, 2007

(65) Prior Publication Data

US 2009/0013728 A1 Jan. 15, 2009

(30) Foreign Application Priority Data

Sep. 29, 2005 (GB) ..... 0519837.9

(51) Int. Cl.
*D04B 1/00* (2006.01)

(52) U.S. Cl. ..... 66/202; 66/171

(58) Field of Classification Search ..... 66/192, 66/195, 202

See application file for complete search history.

(56) References Cited

U.S. PATENT DOCUMENTS 4,087,991 A 5/1978 Robinson et al.
6,145,551 A * 11/2000 Jayaraman et al. ..... 139/387 R
6,341,504 B1 * 1/2002 Istook ..... 66/172 E
6,381,482 B1 * 4/2002 Jayaraman et al. ..... 600/388
6,941,775 B2 * 9/2005 Sharma ..... 66/202
2003/0224685 A1 12/2003 Sharma
2004/0009731 A1 * 1/2004 Rabinowicz ..... 442/316

FOREIGN PATENT DOCUMENTS

| | | | |
|---|---|---|---|
| DE | 27 33 020 | A1 | 2/1978 |
| GB | 2006288 | A | 5/1979 |
| GB | 1571102 | A | 7/1980 |
| WO | 03/087451 | A2 | 10/2003 |
| WO | WO-03/094717 | A | 11/2003 |
| WO | 2004/006700 | A1 | 1/2004 |
| WO | 2004/100784 | A2 | 11/2004 |
| WO | WO-2004/100784 | A | 11/2004 |
| WO | 2005/053532 | A1 | 6/2005 |

OTHER PUBLICATIONS

International Search Report for PCT/GB2006/003651 mailed Mar. 27, 2007.
Patent Search Report for UK Application No. GB0519837.9 mailed Dec. 13, 2005.

* cited by examiner

*Primary Examiner*—Danny Worrell
(74) *Attorney, Agent, or Firm*—Ungaretti & Harris LLP

(57) ABSTRACT

In a method of knitting a garment having a defined axis (A), the knitting layers are formed in a direction parallel to the axis. Pathways (8) defined by distinctive yarns extending substantially parallel to the axis are incorporated in the knitting process seriatim, each distinctive yarn being knitted into its respective pathway using the same yarn feeder. The distinctive yarns are normally conductive, to provide connections to sensors (6) located on the garment, and such sensors may themselves be an integral part of the garment fabric.

23 Claims, 2 Drawing Sheets

KNITTING TECHNIQUES

CROSS-REFERENCE TO RELATED APPLICATIONS

This Application is a U.S. National Stage filing under §371 of International Application No. PCT/GB2006/003651, with an international filing date of 29 Sept. 2006, now pending, claiming priority from Great Britain Application No. GB 0519837.9, with a filing date of 29 Sept. 2005, now pending, and herein incorporated by reference.

TECHNICAL FIELD

This invention relates to knitting techniques, particularly techniques applied to garments in which yarns having particular characteristics must be individually incorporated. Such garments are particularly useful for monitoring physiological signals of the wearer, as sensors attached to or incorporated in the garment can be readily connected by such yarns to a terminal connector located elsewhere on the garment.

Such garments are referred to in a paper presented at the Medicom 2004 conference by R. Paradiso, G. Loriga and N. Taccini, entitled "Wearable Health Care System For Vital Signs Monitoring" and International Publication No. WO04/100784, the disclosures of which are incorporated by reference. The techniques disclosed herein can also be used with sensors of the type disclosed in our co-pending International Application also filed on 29 Sep. 2006 with priority from British Application No: GB05/19836.1, incorporated by reference.

BACKGROUND OF THE INVENTION

Knitted garments are normally produced by knitting progressively in a direction parallel to axis of the garment that when the garment is worn, corresponds with that of the torso of the wearer. Thus, a simple upper body garment such as a vest or a t-shirt, would be knitted from the waist upwards, i.e. with wales parallel and courses orthogonal to the garment axis. Where yarns having particular characteristics must be incorporated in the garment such that they also extend parallel to the torso axis, a separate feeder must be provided for each yarn. This significantly complicates the knitting process.

SUMMARY OF THE INVENTION

The present invention is directed at a method of knitting a garment having a definable axis, with pathways defined by distinctive yarns extending substantially parallel to that axis. According to the invention, knitting is conducted with the knitted rows or courses being formed in a direction parallel to the axis, with the distinctive yarns being incorporated seriatim to define the pathways as the garment is formed. It will be appreciated that with the pathways being substantially parallel, each is concluded before a subsequent one must be commenced, which enables the same yarn feeder to be used for each pathway. Not only does this result in a substantial saving in equipment, but also in space.

If the garment to be formed using a method of the invention is an upper body garment with sleeves, then the method can accommodate extending at least one pathway along a sleeve, again using the same yarn feeder. With the knitting of the garment being conducted in courses parallel to the garment axis, the respective sleeve can be knitted before or after the main body of the garment. In this variant, the method will normally include including the step of knitting an additional wedge of fabric to orient each sleeve relative to the body of the garment.

The method of the present invention is well suited to electronic flat-bed knitting machines, using the techniques of C-knitting and tubular knitting. The use of the electronic flat-bed knitting technology enables the precision positioning of the knitted sensors and conductive pathways in the final product. The horizontal knitting technique, i.e. forming courses parallel to the axis of the garment, facilitates the manufacture of the garment with a minimum of yarn carriers independent of the number of sensors and conductive pathways. The horizontal knitting also facilitates the creation of uninterrupted (continuous) pathway from the waist line of the garment right up to the knitted sensor on a sleeve.

Electronic flat-bed knitting technology methods of the invention can be used to create seamless knitted garments with knitted sensors and conductive pathways for health monitoring purposes. A vest for example, might be created having knitted sensors and conductive pathways, with seams by using a circular knitting process to produce a 2-dimensional flat knitted fabric subsequently formed into a 3-dimensional shell shape.

As described above, the present invention has particular application in the manufacture of garments coupled to or including sensors for recording physiological signals. The yarns defining the pathways can be conductive, and the pathways thereby used to carry signals between sensors and a terminal located elsewhere on the garment. Such sensors maybe attached to or formed as an integral part of the garment as described in International Patent Publication No. WO04/100784 referred to above. The conductive pathways can extend to a boundary of the garment, where terminal connectors may be fitted. Each such connector may be disposed in a pocket formed in the garment.

BRIEF DESCRIPTION OF THE DRAWINGS

The invention will be now described by way of example and with reference to the accompanying schematic drawings wherein.

DETAILED DESCRIPTION OF THE INVENTION

Figure 1:
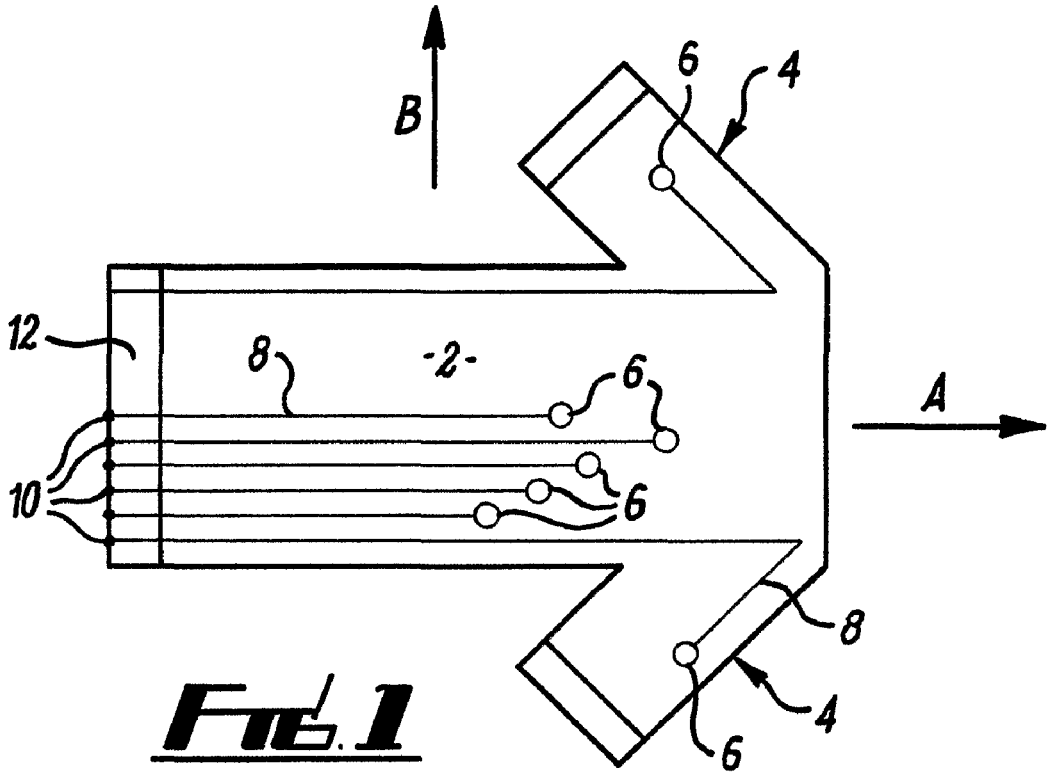
FIG. 1 is a front view of a vest with two sleeves, being an upper body garment suitable for knitting using a method according to the present invention.

The vest illustrated in FIG. 1 comprises a main body section 2 and two sleeves 4. The garment has sensors 6 at various locations thereon, each connected by a conductive pathway 8 to a terminal 10 located at a waist section 12 of the garment. Separate connections can be provided from the terminals 10 to a processing unit carried elsewhere by the wearer for recordal or possible wireless transmission to a remote processor.

A garment of the kind illustrated in FIG. 1 would normally be knitted from left to right as shown along an axis parallel to the garment axis (A), commencing at the waist section 12. It will be appreciated that to accomplish this incorporating the seven conductive pathways 8 as shown, will require a separate yarn feeder for each pathway. If the sensors 6 are knitted into the garment as an integral element thereof, then up to thirteen separate feeders may be needed. However, according to the invention the garment is knitted in the transverse direction; arrow (B) as shown, starting at the end of one sleeve 4, and finishing at the end of the other. By knitting in this direction, each conductive pathway 8 is completed before another must commence. This means that the same yarn feeder such as an intarsia yarn feeder, can be used for each pathway. In the garment illustrated, for each but the last pathway 8 the respective sensor 6 is knitted before the pathway itself, with the same yarn feeder being used for the last pathway before the last sensor 6 is knitted in the second sleeve. The same yarn feeder can be used not only for each pathway 8, but also for each sensor 6.

Figure 2:
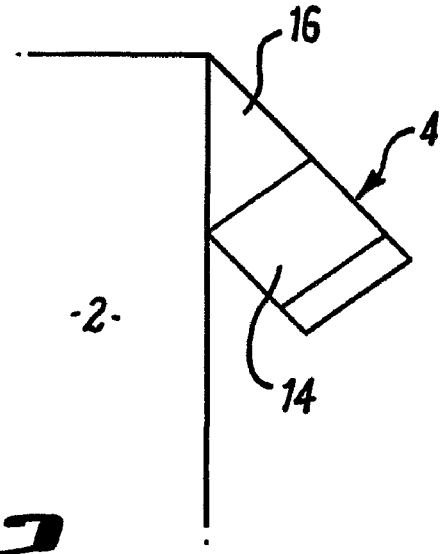
FIG. 2 illustrates one means by which a sleeve in the garment of FIG. 1 can be oriented relative to its main body.

FIG. 2 shows the junction of a sleeve with the garment body, with the sleeve consisting of two separate parts. Its distal end 14 is knitted in a circular knitting process, and then the proximal end 16 is knitted using a C-knitting process in the form of a wedge to orient the sleeve 4 relative to the body 2. In an alternative technique shown in FIG. 3, the end section of the sleeve is knitted perpendicular to the main body, with the wedge omitted from the underarm section. The edges of the wedge 18 are closed during the knitting process to orient the sleeve 4 relative to the body 2.

Figure 3:
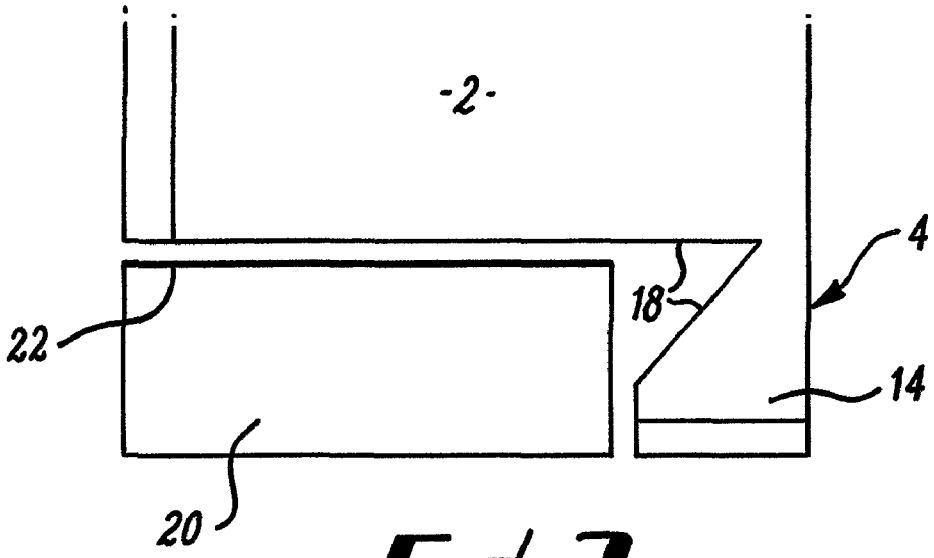
FIG. 3 illustrates an alternative means by which a sleeve may be oriented.
Figure 4:
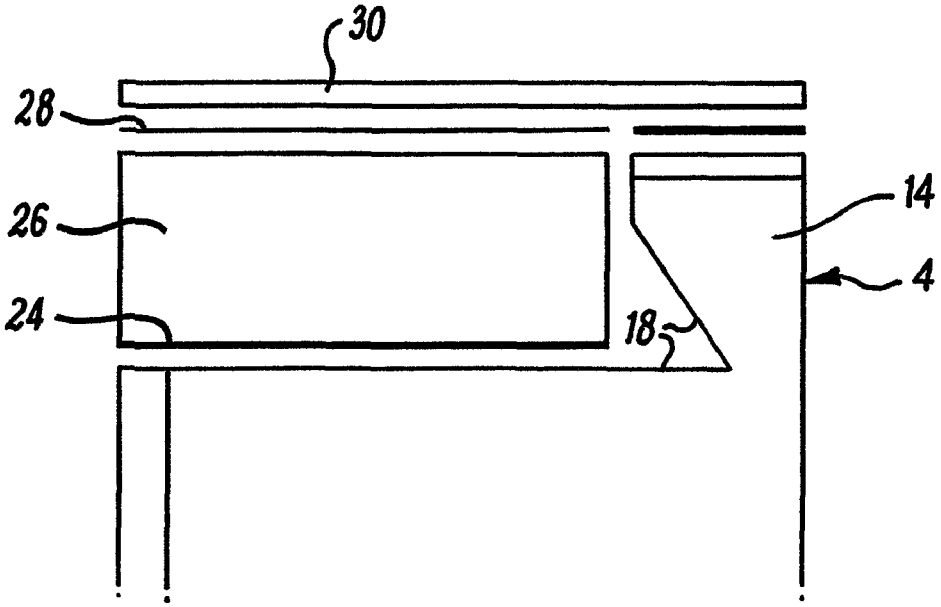
FIG. 4 illustrates how the means shown in FIG. 3 can be adapted to complete the knitting process.

In the method illustrated in FIG. 3, waste fabric 20 is knitted to achieve a balanced take down control during the knitting process. When the main body 2 is reached, a draw thread 22 is introduced to allow for separation of the waste fabric from the body. Substantially the same steps are followed at the end of the knitting process as illustrated in FIG. 4. When the main body section is completed, this is bound off with a draw thread 24 with waste fabric (26) being knitted as the other sleeve is completed after which the garment is bound off with a further draw thread 28 followed by a final section 30 of waste fabric. The draw threads 22 and 24 serve to lock the front and rear of the body.

Conventional knitting yarn, elastomeric yarn and conductive yarns can be used in methods of the invention. For the main garment a suitable yarn has a core of 44f14 Nylon/156 Decitex Lycra (38.9\%) with inner (30.1%) and outer (31.0%) covers of 1/78f46 textured Nylon PA66DD. The preferred conductive yarn comprises silver. The invention can be advantageously practised using the C-knitting process which is a well used technique of flat-bed knitting. The C-knitting process particularly facilitates the formation of the waist section without any seams. The waist section can be adapted particularly to accommodate terminal connections, and edges of the garment can be bound off during the knitting process. However, the sleeves may be created with conductive pathways and knitted sensors by using the tubular knitting process, also a well known in flat-bed knitting. Typically tubular knitting processes can also be employed, with the method including the step of cutting the knitted structure to form waist and neck openings.

The invention claimed is:

1. A method of knitting a garment having an axis and a plurality of pathways defined by conductive yarns extending substantially parallel to said axis, the yarns extending to a plurality of individual sensors created in the garment during a knitting process, each comprising a knitted electrically conductive fibre forming an integral part of the garment fabric, wherein a plurality of knitting rows are formed in a direction parallel to said axis incorporating the conductive yarns seriatim to define the pathways as the garment is formed, and wherein each conductive yarn is knitted into its respective pathway using the same yarn feeder.

2. A method according to claim 1 wherein the pathways include at least one additional pathway extending at an angle to said axis.

3. A method according to claim 2 wherein the garment is an upper body garment with sleeves, and wherein a said additional pathway extends along a sleeve.

4. A method according to claim 3 wherein a distinctive yarn is knitted into said additional pathway in a sleeve using the same yarn feeder.

5. A method according to claim 1 wherein the sensors are transducers knitted into the fabric.

6. A method according to claim 1 wherein the pathways extend to a boundary of the product, the method including the step of fitting terminal connectors to the pathways at the boundary.

7. A method according to claim 6 wherein each terminal connector is disposed in a pocket formed in the garment.

8. A method according to claim 1 wherein the garment is an upper body garment with sleeves, and wherein knitting commences at the end of a sleeve.

9. A method according to claim 8 including the step of knitting an additional wedge of fabric to orient each sleeve relative to the body of the garment.

10. A method according to claim 8 including the step of knitting waste fabric adjacent the sleeves, and introducing a draw thread to facilitate separation of such waste fabric from the body of the garment.

11. A method according to claim 10 wherein the garment is an upper body garment, and including the step of cutting the knitted structure to form waist and neck openings.

12. A method according to claim 1 using a C-knitting process.

13. A method according to claim 12 wherein the garment is an upper body garment, and wherein the C-knitting process leaves a waist section opening.

14. A method according to claim 1 using a flat-bed knitting process.

15. A method according to claim 1 using a circular knitting process.

16. A method of knitting an upper body garment having sleeves, with an axis and a plurality of pathways defined by conductive yarns extending substantially parallel to said axis and an additional conductive pathway extending along a sleeve, the yarns extending to a plurality of individual knitted sensors created in the garment during a knitting process and forming an integral part of the garment fabric, each sensor comprising knitted conductive fibres connected to the respective conductive pathways, wherein a plurality of knitting rows are formed in a direction parallel to said axis incorporating the conductive yarns seriatim to define the pathways as the garment is formed, and wherein each conductive yarn is knitted into its respective pathway using the same yarn feeder.

17. A method according to claim 16 wherein the sensors are transducers knitted into the fabric.

18. A method according to claim 16 wherein the pathways extend to a boundary of the product, the method including the step of fitting terminal connectors to the pathways at the boundary.

19. A method according to claim 16 wherein knitting commences at the end of a sleeve.

20. A method according to claim 16 including the step of knitting an additional wedge of fabric to orient each sleeve relative to the body of the garment.

21. A method according to claim 16 including the step of knitting waste fabric adjacent the sleeves, and introducing a draw thread to facilitate separation of such waste fabric from the body of the garment.

22. A method according to claim 16 using a C-knitting process.

23. A method according to claim 22 wherein the garment is an upper body garment, and wherein the C-knitting process leaves a waist section opening.

* * * * *